United States Patent [19]

Beck

[11] 4,357,502

[45] Nov. 2, 1982

[54] PHASE REVERSAL SWITCH MECHANISM

[75] Inventor: Henry R. Beck, Pittsburgh, Pa.

[73] Assignee: Westinghouse Electric Corp., Pittsburgh, Pa.

[21] Appl. No.: 219,205

[22] Filed: Dec. 22, 1980

[51] Int. Cl.[3] ..... H01H 9/00; H01H 3/00

[52] U.S. Cl. ..... 200/1 V; 200/18

[58] Field of Search ..... 200/1 R, 1 V, 5 R, 17 R, 200/17 B, 18; 290/52; 307/127; 361/245, 246

[56] References Cited

U.S. PATENT DOCUMENTS 3,673,426 6/1972 Weston et al. ..... 290/52 X

*Primary Examiner*—J. R. Scott

*Attorney, Agent, or Firm*—Robert E. Converse, Jr.

[57] ABSTRACT

Phase reversal switch apparatus for a three-phase high-current isolated phase bus circuit includes a non-reversing phase switch, and two groups of two reversing phase switches. The apparatus also includes a phase reversal mechanism having a rotatable operating shaft with a drive lever, a non-reversing lever, and two reversing levers coupled thereto. Locking and drive couplings are selectively engaged with the levers and operated by a shift actuator and a switch actuator to selectively operate the non-reversing switch and the first and second reversing switches to effect a phase sequence reversing operation in a secure and efficient manner.

14 Claims, 11 Drawing Figures

PHASE REVERSAL SWITCH MECHANISM

BACKGROUND OF THE INVENTION

1. Field of the Invention

The invention relates to multi-phase electrical switch apparatus and, more particularly, to apparatus utilizing multi-phase electrical switches for providing phase reversal of associated multi-phase electrical circuits.

2. Description of the Prior Art

Certain applications in the generation, transmission, distribution, and utilization of electrical energy require the reversal of phases of a multi-phase electrical circuit. For example, pumped-storage electrical generation projects utilize a dual mode dynamoelectric machine in the motor mode to pump water into a reservoir to increase the head behind a dam. This pumping occurs during off-peak hours when the total load on the utiliy grid is low. When the demand for electrical energy on the grid increases, the reservoir is drained to drive the dynamoelectric machine in the generator mode to produce electric power which is supplied to the grid. The transformation between motor mode and generator mode is accomplished by reversing the phase connections to the machine. To provide this phase reversal in a three-phase system generally requires a five-pole switch and a mechanism for operating the poles in the proper sequence.

Such a mechanism must meet a variety of requirements. The mechanism must be adaptable to accommodate variations in the phase-to-phase spacing encountered in various mounting configurations and it should be positively linked o all switches at all times and at all positions of travel of the switches from the fully opened position to the fully closed position. This is to prevent accidental opening or closing of the switches due to vibrations or gravity. During the phase-reversal cycle, one of the switches must open fully and reclose fully. Furthermore, all five switches should be completely open at the mid-point of the phase reversal cycle; that is, no switches should be opening while the others are closing. It is desirable to provide a mechanism which meets these requirements in an efficient, economical manner.

SUMMARY OF THE INVENTION

In accordance with the principals of the presen invention, there is provided a phase reversal switch assembly which includes first and second groups of reversing phase switches, a non-reversing phase switch, a rotatable operating shaft, and switch actuator means operable between open and closed positions to provide motive power to open and close the switches. A drive lever is connected to the switch actuator means and is movably coupled to the shaft so as to permit torque to be transmitted to the shaft at all times. A non-reversing switch lever is connected to the non-reversing phase switches and is movably coupled to the shaft so as to permit torque to be transmited from the shaft to the non-reversing switch lever at all times. First and second reversing switch levers movably coupled to the shaft are also provided to respectively operate the first and second groups of reversing switches between open and closed positions. Drive coupling means are provided for selectively engaging with the first and second reversing switch levers and are operable when engaged to transmit torque in the shaft to one of the reversing switch levers. Locking coupling means also selectively engageable with the first and second reversing switch lever means are provided which are operable when engaged to lock one of the reversing switch levers in an open position. The relative positions of the drive and locking couplings prevents reversing the engagement during the switching operation. Link means are coupled to the locking and drive coupling means and to the first and second reversing switch lever means and are operable between first and second positions by a shift actuator to cause the locking coupling means to engage one of the reversing switch lever means and the drive coupling means to engage the other of the reversing switch lever means. Operation of the link means to the first position is operable to cause the drive coupling means to engage the first reversing switch lever means and the locking coupling means to engage a second reversing switch lever means such that subsequent operation of the switch actuator to the closed position is operable to cause the operating shaft to transmit torque to the first reversing switch lever means and cause the first group of reversing phase switches and the non-reversing phase switch to move to the closed position.

Operation of the link means to the second position is operable to cause the drive coupling means to engage the second reversing switch lever means and the locking coupling means to engage the first reversing switch lever means such that subsequent operation of the switch actuator means to the closed position is operable to cause the second group of reversing phase switches and the non-reversing phase switch to move to the closed position.

DESCRIPTION OF THE PREFERRED EMBODIMENT

Figure 1:
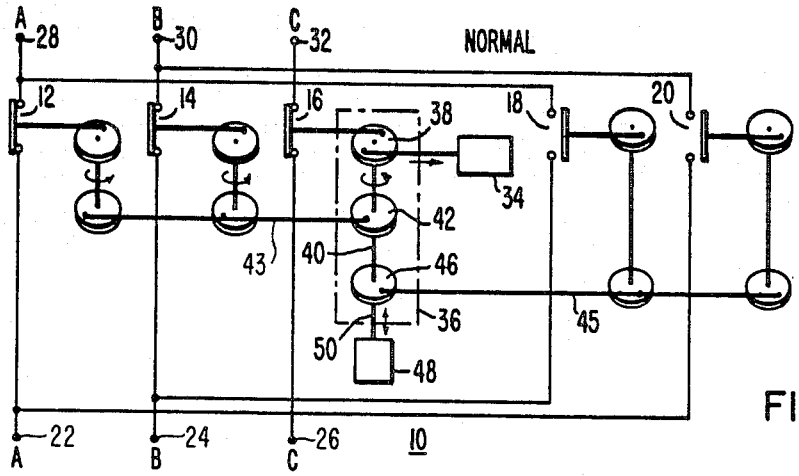
FIG. 1 is an electromechanical schematic diagram of a three-phase five-pole switch assembly shown in the normal phase sequence condition.

Referring now to the drawings, in which corresponding reference characters refer to corresponding elements, there is shown in FIG. 1 an electromechanical schematic diagram of a three-phase five-pole switch assembly in the CLOSE position, normal phase sequence configuration. The assembly 10 includes five identical phase switches 12, 14, 16, 18 and 20 which may be, for example, the type disclosed in copending application Ser. No. 219,716, filed Dec. 24, 1980 by Zwillich et al. now U.S. Pat. No. 4,339,635 and assigned to the assignee of the present invention. These switches are telescoping disconnect switches adapted to be connected in isolated phase bus configurations to carry continuous current levels on the order of 25,000 amperes at a potential of approximately 16,000 volts. Although the assembly 10 is described in connection with disconnect switches of the type described in the aforementioned Zwillich et al. application, it is contemplated that other types of disconnect switches could be utilized.

The switch assembly 10 includes three input terminals 22, 24, and 26 carrying input phases A, B, and C, respectively. The assembly 10 also includes three output terminals 28, 30, and 32 which in the normal configuration of the switch will supply phases A, B, and C, respectively. In the reverse configuration of the switch, the output terminals 28, 30, and 32 will supply phases B, A, and C, respectively; that is, the phases of output terminals 28 and 30 are interchanged.

Terminal 32 connected to switch 16 always supplies phase C whenever switch 16 is closed. Thus, the switch 16 is referred to as the non-reversing switch. The other switches 12, 14, 18, and 20 are referred to as reversing switches and are separated into two groups; switch 12 and switch 14 being referred to collectively as the first group of reversing switches and the switches 18 and 20 being referred to collectively as the second group of reversing switches. Correspondingly, phase C is referred to as the non-reversing phase whereas phases A and B are referred to as the reversing phases. Each group of reversing switches is actuated in common, that is, switch 12 and switch 14 are either simultaneously open or simultaneously closed. Similarly, switches 18 and 20 are either simultaneously open or simultaneously closed. Each group of reversing switches is thus actuated together.

Figure 2:
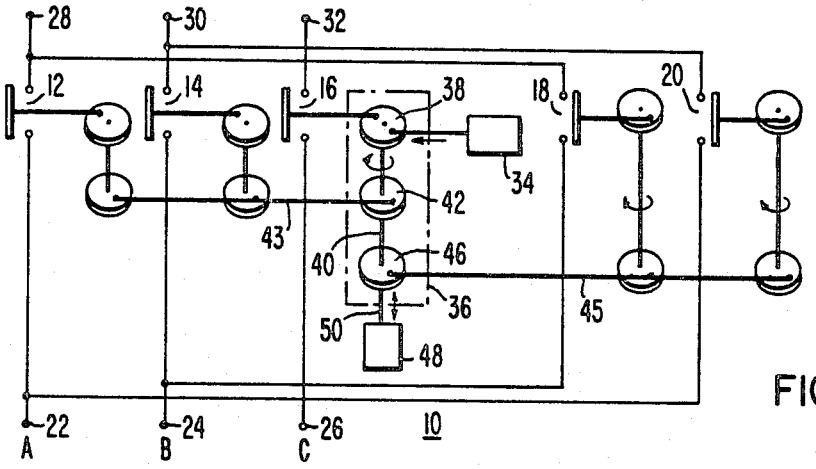
FIG. 2 is a diagram of the switch assembly of FIG. 1 shown in the mid-point of an operating cycle, with all poles fully open.
Figure 3:
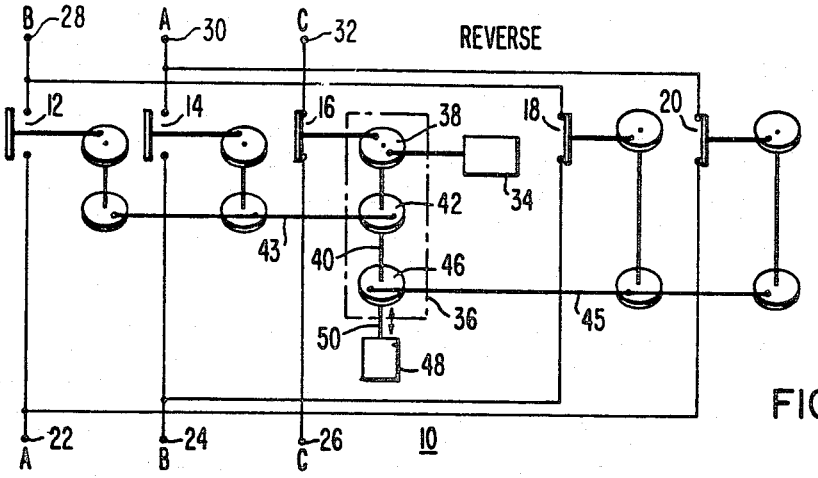
FIG. 3 is a diagram of the switch shown in FIG. 1, shown in the reverse phase sequence condition.

A complete phase reversal cycle of the assembly 10 is illustrated by the FIGS. 1, 2 and 3. In FIG. 1, the non-reversing phase switch 16 and the first group of reversing phase switches 12 and 14 are all closed, whereas the second group of reversing switches 18 and 20 is open. To initiate a phase reversal cycle, a switch actuator, shown schematically as 34, operates upon a mechanism 36. The mechanism 36 includes a combination drive and non-reversing switch lever 38 rigidly connected to an operating shaft 40. Operation of the switch actuator 34 to produce a rectilinear motion causes the combination lever 38 to rotate and transmit torque to the operating shaft 40. Rotation of the combination lever 38 is also operable to actuate the non-reversing switch 16 between open and closed positions. Separate drive and non-reversing switch levers could be provided to perform the functions of the combination lever 38.

The mechanism 36 also includes first and second reversing switch, or phase, levers 42 and 46, respectively, which are also coupled to the shaft 40. Unlike the combination lever 38, however, they are not coupled to the shaft 40 so as to permit torque to be transmitted from the shaft to the levers at all times. Rather, a shift actuator 48 operates a shift link shown schematically at 50 between NORMAL and REVERSE positions to selectively engage for torque transmission one or the other of the reversing switch levers 42 and 46 with the operating shaft 40, but not both of the levers 42 and 46. The lever 42 or 46 not so engaged is locked so as to maintain its corresponding group of reversing switches in the OPEN position.

As can be seen in FIG. 2, the mid-point of the phase reversal cycle results in all switches 12, 14, 16, 18, and 20 being placed in the OPEN position, by operation of the switch actuator 34. The shift actuator 48 is then operated to the REVERSE position to engage the second reversing phase lever 46 with the operating shaft 40 and disengage and lock the first reversing phase lever 42. Thus, subsequent operation of the switch actuator 34 to the CLOSE position as shown in FIG. 3 results in rotation of the second reversing switch lever 46 and the combination lever 38 (which is continuously engaged with the shaft 40) to cause the switches 16, 18 and 20 to be operated to the CLOSE position while the switches 12 and 14 remain locked in the OPEN position. It can thus be seen that the phase sequence configuration appearing at the output terminals 28, 30 and 32 has been reversed.

Figure 4B:
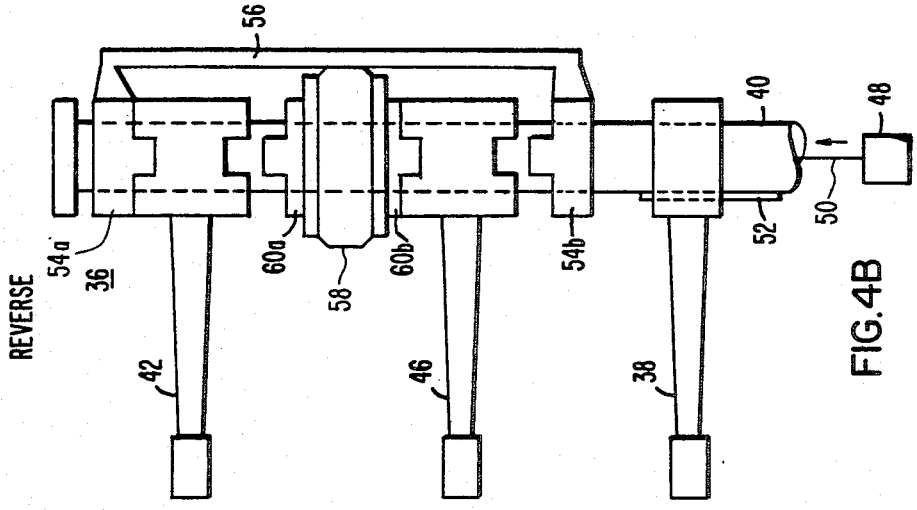
FIG. 4B is a view similar to FIG. 4A, with the mechanism shown in the mid-point of the phase-reversal cycle just prior to operation of the assembly to the reverse condition.
Figure 4A:
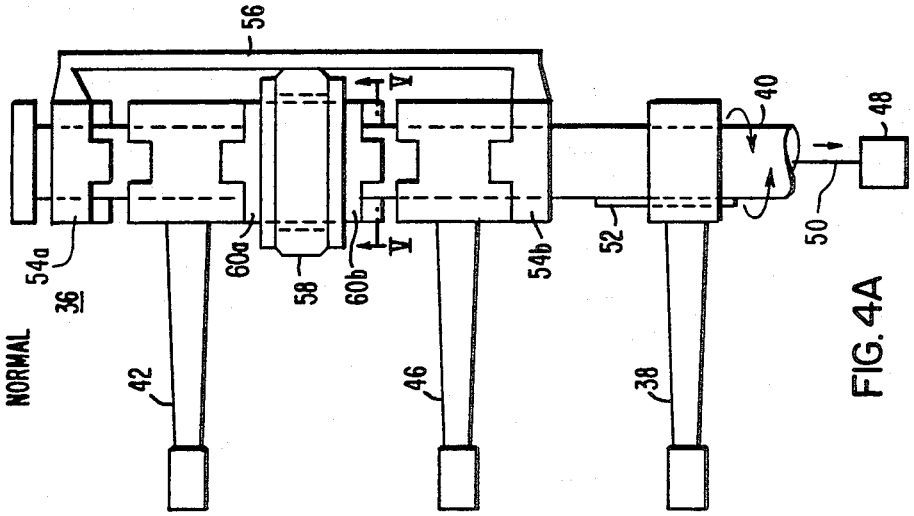
FIG. 4A is a side-elevational view of a phase reversal mechanism of the switch assembly of FIG. 1, shown at the mid-point of a phase-reversal cycle with the switch actuator in the OPEN position, prior to operation of the assembly to the normal condition.

The operating mechanism 36 of the assembly 10 is shown more clearly in FIG. 4A. As can be seen, the operating shaft 40 is free to both rotate and translate axially in a vertical direction as seen in the drawings. The shaft 40 extends through the combination drive and non-reversing switch lever 38. A spline 52 rigidly attached to the shaft 40 passes through a keyway in the combination lever 38 to ensure that the combination lever 38 rotates with the shaft 40 at all axial positions thereof.

The shaft 40 also extends through a pair of locking couplings **54*a* and 54*b*, and is free to rotate therewithin. The locking couplings 54*a* and 54*b* are connected by a link member 56 which rigidly supports a bearing 58 surrounding the shaft 40. Attached to either side of the bearing 58 are a pair of drive couplings 60*a* and 60*b* fixedly attached to the operating shaft 40 to rotate and axially translate along with the shaft 40. Each of the levers 42, 46, and 38 are free to rotate but are constrained by portions of the connecting mechanism (not shown) to prevent movement in a vertical direction as shown in the drawing. Thus, the operating shaft 40, the locking couplings 54*a* and 54*b*, the bearing 58, the drive couplings 60*a* and 60*b*, and the link member 56 all move as a unit in the vertical direction when so operated by the shift actuator 48. Rotation of the operating shaft 40 causes corresponding rotation of the combination lever 38, the drive couplings 60*a* and 60*b*, and either the first reversing switch lever 42 or the second reversing switch lever 46, depending on which of these levers is engaged by one of the drive couplings 60*a* and 60*b* as determined by the axial position of the operating shaft 40**.

Figure 5A:
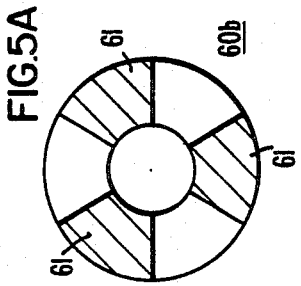
FIG. 5A is a sectional view of the drive coupling of the mechanism of FIG. 4A, taken along the line V—V, when the switch actuator is in the OPEN position.
Figure 5B:
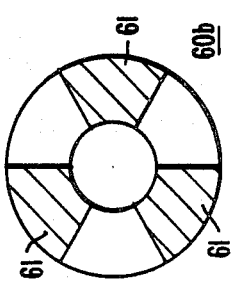
FIG. 5B is a view similar to FIG. 5A, with the switch actuator is in the CLOSE position.

FIG. 5A is a sectional view of the drive coupling 60 taken along the line V—V of FIG. 4A. As can be seen, the coupling **60*b* includes three symmetrically disposed teeth 61. The teeth 61 mate with corresponding recesses in the second reversing switch lever 46 to allow the drive coupling 60*b* to engage the lever 46 as shown in FIG. 4B. Operation of the switch actuator 34 to the CLOSE position rotates the drive coupling 60***b* 90° to the position shown in FIG. 5*b*.

The locking couplings 54*a* and 54*b* and lever 42 also have corresponding teeth and recesses similar to those described. It can be seen that since there are an odd number of teeth and recesses and that the switch positions are 90° apart, the drive couplings 60*a* and 60*b* cannot engage a reversing switch lever unless both the drive coupling and reversing switch lever are in the same position (either OPEN or CLOSE). Different rotation angles and teeth arrangements could, of course, be used, but more secure operation is provided if the arrangements are such as to provide the lock-out feature as described above.

The operation of the mechanism 36 in effecting a phase reversal cycle will now be described in relation to FIGS. 4A and 4B. FIG. 4A shows the condition of the mechanism 36 when all of the switches 12, 14, 16, 18, and 20 are open prior to closing to produce a normal phase output on the terminals 28, 30, and 32. As can be seen, the lower locking coupling 54*b* is engaged with the second reversing switch lever 46. The upper drive coupling 60*a* is engaged with the first reversing switch lever 42. Operation of the switch actuator 34 (FIG. 1) produces a linear force on the combination drive and non-reversing switch lever 38 which in turn produces a torque upon the operating shaft 40 through the spline 52. The shaft 40 then rotates under the action of the switch actuator 34 approximately 90°. Since the lower locking coupling 54*b* is engaged with the second reversing switch lever 46, this lever remains locked in the same position as shown in FIG. 4A, causing the corresponding second group of reversing switches to remain locked in the OPEN position. The upper drive coupling 60*a* rotates with the shaft 40, and since the drive coupling 60*a* is engaged with the first reversing switch lever 42, this lever also rotates about 90° with respect to the operating shaft 40. This causes the first connecting rod 43 (FIG. 1) to actuate the first group of reversing switches 12 and 14 to the CLOSED position. Since the lever 38 actuates the non-reversing switch 16, this switch is also operated to the CLOSE position simultaneously with the switches 12 and 14. The assembly 10 then corresponds to the configuration shown in FIG. 1.

To effect a reversal of the phases appearing on the terminals 28, 30 and 32, the switch actuator 34 is operated to the OPEN position rotating the operating shaft 40 and causing the mechanism 36 to once again assume the positions shown in FIG. 4A. All of the switches 12, 14, 16, 18 and 20 are now in the OPEN position, as shown in FIG. 2. Next, the shift actuator 48 is operated to the REVERSE position to move the shaft 40 axially in a downward direction as shown in FIG. 4A to assume the configuration shown in FIG. 4B. As can be seen therein, the upper locking coupling 54*a* engages the first reversing switch lever 42 and the lower locking coupling 54*b* disengages the second reversing switch lever 46. Correspondingly, the upper drive coupling 60*a* disengages the first reversing switch lever 42 and the lower drive coupling 60*b* engages the second reversing switch lever 46. The lever 38 remains engaged with the operating shaft 40 since the spline 52 is of sufficient length to maintain engagement at all axial positions of the shaft 40.

To complete the phase-reversal operation, the switch actuator 34 is now operated to the CLOSE position. This causes the combination lever 38 to rotate and close the non-reversing switch 16. Rotation of the lever 38 also transmits torque through the spline 52 to rotate the shaft 40. Since the first reversing switch lever 42 is engaged by the upper locking coupling 54*a* it remains locked in the OPEN position. The second reversing switch lever 46, however, is engaged by the lower drive coupling 60*b*. Since this coupling is rigidly connected to the shaft 40, rotation of the shaft 40 causes rotation of the second reversing switch lever 46 simultaneously with rotation of the combination lever 38. The lever 46 operates the second connecting rod 45 to move the second connecting rod 45 to move the second group of reversing switches 18 and 20 to the CLOSE position simultaneously with the switch 16. The assembly 10 thus assumes the condition shown in FIG. 3, wherein the terminals 28, 30, and 32 now supply phases B, A, and C, respectively. This completes a phase reversal operation.

Figure 6B:
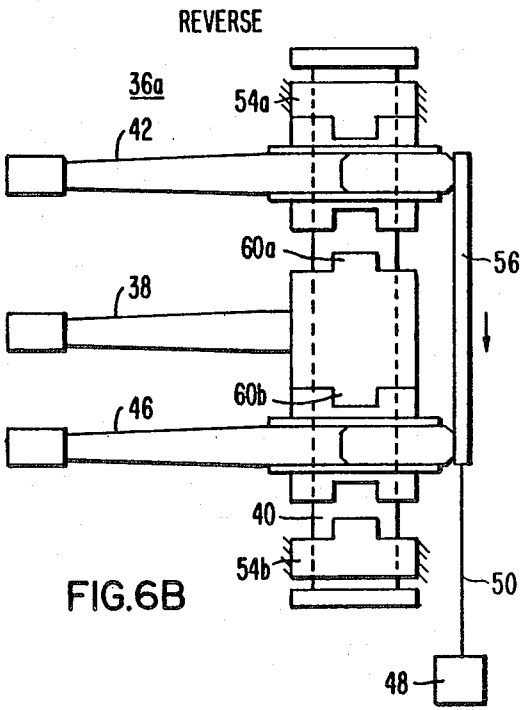
FIG. 6B is the mechanism of FIG. 6A, when the assembly is in a condition similar to that of FIG. 4B.
Figure 6A:
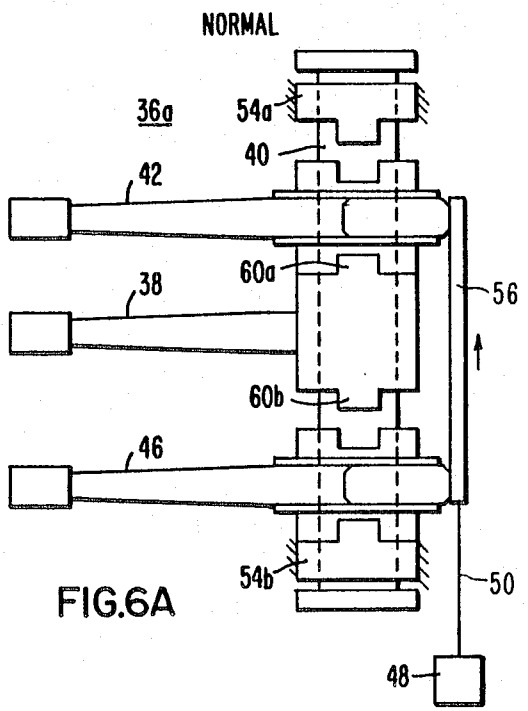
FIG. 6A is a side elevational view of a phase-reversal mechanism of a first alternative embodiment of the invention when the assembly is in a condition similar to that of FIG. 4A.

FIGS. 6A and 6B are similar to FIGS. 4A and 4B, but illustrate a first alternative embodiment 36*a* of the operating mechanism 36. In the mechanism of 36*a*, the operating shaft 40 is free to rotate, but is prevented from moving in the axial direction. The locking couplings 54*a* and 54*b* are fixedly mounted to structure (not shown) to prevent both rotational and axial motion. Similarly, the combination drive and non-reversing switch lever 38 is supported by a connecting linkage (not shown) to permit rotational movement but prevent any motion in the axial direction. The first and second reversing switch levers 42 and 46 are rigidly connected by the shift link 56 and are operated on by the shift actuator 48 to move in an up and down direction as shown in FIGS. 6A and 6B. In a manner similar to the previously described embodiment, a normal phase configuration on the terminals 28, 30 and 32 of FIG. 1 is achieved by operation of the switch actuator 34 to the CLOSE position with the shift actuator 48 in the NORMAL configuration positioning the first and second reversing switch levers 42 and 46 and the shift link 56 in the position shown in FIG. 6A. Such operation of the switch actuator 34 will result in rotation of the combination lever 38 and first reversing switch lever 42 to close the switches 12, 14, and 16. The switches 18 and 20 which are driven by the second reversing switch lever 46 remain locked in the OPEN position due to the engagement of the switch 46 with the lower locking coupling 54*b* as shown in FIG. 6A.

To perform a phase reversal operation, the switch actuator 34 is operated to the OPEN position returning the mechanism 36*a* to the configuration shown in FIG. 6A. The shift actuator 48 is then operated to move the mechanism 36*a* from the NORMAL condition shown in FIG. 6A to the REVERSE condition shown in FIG. 6B. As can be seen therein, the first and second switch levers 42 and 46 and the shift link 56 have been moved in an upward direction to the position shown. The first reversing switch lever 42 is now engaged by the upper locking coupling 54*a* and the second reversing switch lever 46 engaged by the lower drive coupling 60*b* connected to the combination drive and non-reversing switch lever 44. Subsequent operation of the switch actuator 34 from the OPEN to the CLOSE position will result in rotation of the lever 44 and the second reversing switch lever 46 to close switches 16, 18, and 20. The first reversing switch lever 42 remains in the position shown in FIG. 6B, resulting in the switches 12 and 14 being locked in the OPEN position.

Figure 7B:
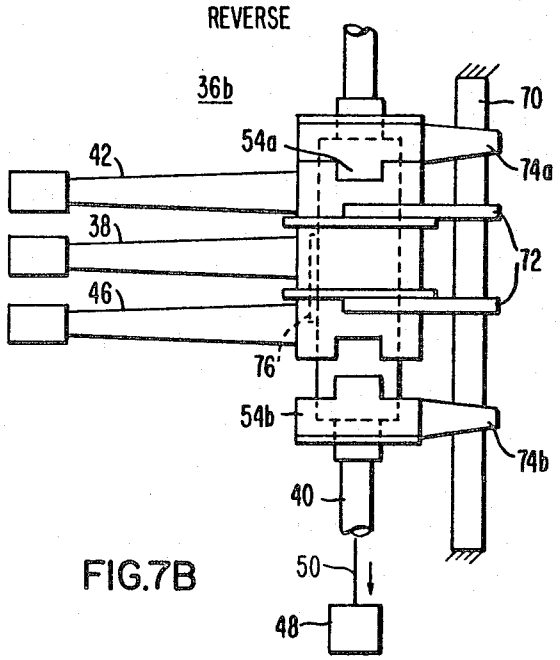
FIG. 7B is the mechanism of FIG. 7A, when the assembly is in a condition similar to that of FIG. 4B.
Figure 7A:
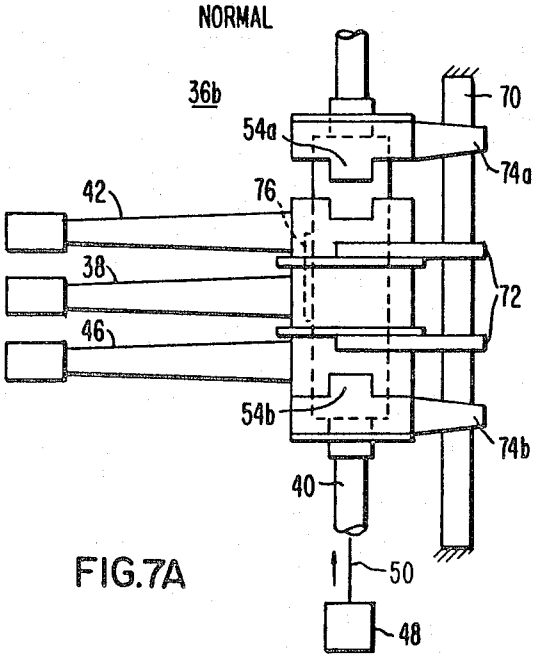
FIG. 7A is a side elevational view of a phase-reversal mechanism of a second alternative embodiment of the invention, when the assembly is in a condition similar to that of FIG. 4A.

A second alternative embodiment of the invention may be implemented using a mechanism 36*b* as shown in FIGS. 7A and 7B. Mechanism 36*b* operates according to the same principles as the mechanisms 36 and 36*a*, but in a slightly different manner. A stationary shaft 70 is mounted parallel to the operating shaft 40. Retaining rings 72 secured to the shaft 70 support the combination drive and non-reversing switch lever 38 and the first and second reversing switch levers 42 and 46, permitting these levers to rotate but preventing up and down motion as seen in FIGS. 7A and 7B. The operating shaft 40 is axially movable in an up and down direction in response to operation of the shift actuator 48. Attached to the shaft 40 are the locking couplings 54*a* and 54*b* which are prevented from rotating by sliding collars 74*a* and 74*b* which slide up and down along the shaft 70. The operating shaft 40 is, however, free to rotate within the locking couplings 54*a* and 54*b*. Also attached to the shaft 40 is a drive spline 76 which performs the function of the drive couplings 60*a* and 60*b* of the mechanism 36 and 36*a*. The spline 76 is engageable with keyways formed in the levers 42, 38, and 46. As can be seen in FIGS. 7A and 7B, the spline 76 is engaged with the keyway of the lever 38 in all positions of the operating shaft 40. When the shift actuator 48 is in the NORMAL position, the drive spline 76 engages the first reversing switch lever 42. When the shift actuator 48 is in the REVERSE position, the drive spline disengages the lever 42 and engages the lever 46. A phase reversal operation can be accomplished in the manner similar to that described with regard to the mechanisms 36 and 36*a*. It can be seen therefore that the present invention provides a phase reversal switch assembly which achieves the stated requirements in an efficient and economic manner.

I claim:

1. Phase reversal switch apparatus, comprising:

first and second groups of reversing phase switches;

a non-reversing phase switch;

a rotatable operating shaft;

drive lever means coupled to said operating shaft so as to permit torque to be transmitted thereto;

switch actuator means connected to said drive lever for moving said drive lever means to cause said operating shaft to rotate between OPEN and CLOSE positions;

non-reversing switch lever means coupled to said drive lever means to permit torque to be transmitted therefrom and connected to said non-reversing phase switch for rotating to operate said non-reversing phase switch between OPEN and CLOSE position;

first and second reversing switch lever means movably coupled to said operating shaft and respectively connected to said first and second groups of reversing phase switches for individually rotating to selectively operate said first and second groups of reversing switches between OPEN and CLOSE conditions;

drive means coupled to said operating shaft and selectively engageable with said first and second reversing switch lever means, for transmitting torque from said operating shaft to one of said reversing switch lever means when engaged therewith;

locking means selectively engageable with said first and second reversing switch lever means for locking one of said reversing switch lever means when engaged therewith to lock the corresponding group of reversing phase switches in the OPEN position;

shift link means coupled to said locking means, said drive means, and said first and second reversing switch lever means and operable between NORMAL and REVERSE positions for selectively engaging said locking and drive means with said first and second reversing switch lever means; and a shift actuator connected to shift link means for moving said shift link means between said NORMAL and REVERSE positions;

operation of said shift actuator being operable to move said shift link means to said NORMAL position causing said drive means to engage said first reversing switch lever means and said locking means to engage said second reversing switch lever means, whereby subsequent operation of said switch actuator means to the CLOSE position rotates said operating shaft to result in closing of said non-reversing phase switch and of said first group of reversing phase switches and locking of said second group of reversing phase switches in an open circuit condition;

operation of said shift actuator to move said shift link means to said REVERSE position causing said drive means to engage said second reversing switch lever means and said locking means to engage said first reversing switch lever means whereby subsequent operation of said switch actuator means to the CLOSE position rotates said operating shaft to result in closing of said non-reversing phase switch and said second group of reversing phase switches, and locking of said first group of reversing phase switches in an open circuit condition.

2. Apparatus as recited in claim 1 wherein;

said locking means comprises a pair of locking couplings surrounding said operating shaft and permitting axial and rotational movement of said operating shaft therewithin;

said drive means comprises a pair of drive couplings rigidly connected to said operating shaft such that said drive couplings and said operating shaft rotate as a unit;

said shaft link means comprises a bearing connected to said operating shaft and permitting rotation of said operating shaft therewithin, and a link member connected to said locking couplings and said bearing; and said operating shaft is connected to said shift actuator and is axially movable such that said locking means, said drive means, said bearing, said link member, and said operating shaft are movable as a unit between NORMAL and REVERSE positions.

3. Apparatus as recited in claim 2 wherein said operating shaft comprises a spline attached thereto and slidingly keyed to said drive lever means and said non-reversing switch lever means, said spline being of sufficient length to engage said drive lever means and said non-reversing switch lever means when said operating shaft is in either the NORMAL or the REVERSE position.

4. Apparatus as recited in claim 2 wherein said drive means and said non-reversing switch lever means comprise a single combination drive and non-reversing switch lever.

5. Apparatus as recited in claim 2 wherein said drive couplings and said locking couplings each comprise a plurality of teeth, and said reversing switch levers each comprise a plurality of recesses to cooperate with said teeth to allow torque to be transmitted between said couplings and said levers when said levers are engaged with said couplings as a result of operation of said shift actuator.

6. Apparatus as recited in claim 5 wherein the relationship between the angular distance between OPEN and CLOSE positions of said operating shaft and the number of said teeth is such as to prevent engagement of said locking coupling and said reversing switch levers when said levers are in the closed position whereby locking of said switches in the closed circuit position by inadvertent operation of said shift actuator is prevented.

7. Apparatus as recited in claim 1 wherein:

said locking means comprises a pair of locking couplings surrounding said operating shaft and permitting rotational movement of said operating shaft therewithin;

said drive means comprises a pair of drive couplings rigidly connected to said operating shaft such that said drive couplings and said operating shaft rotate as a unit;

said first and second reversing switch lever means comprise first and second reversing switch levers surrounding said operating shaft and axially and rotationally movable with respect to said operating shaft;

said shift link means comprises a link member connected to said shift actuator and connecting said first and second reversing switch levers such that said first and second reversing switch levers rotate independently but move as a unit between NORMAL and REVERSE positions in an axial direction with respect to said operating shaft in response to operation of said shift actuator.

8. Apparatus as recited in claim 7 wherein said drive lever means and said non-reversing switch lever means comprise a single combination lever rigidly connected to said operating shaft rotatable as a unit therewith.

9. Apparatus as recited in claim 8 wherein:

said drive means comprises a plurality of teeth formed in said combination lever and a plurality of cooperating recesses formed in said first and second reversing switch levers, said recesses engaging said teeth to allow torque to be transmitted from said combination lever to one of said reversing switch levers upon operation of said shift actuator, and said locking couplings comprise a plurality of teeth formed therein and a plurality of cooperating recesses formed in said first and second reversing switch levers, said recesses engaging said teeth to lock one of said reversing switch levers in an open position upon operation of said shift actuator.

10. Apparatus as recited in claim 9 wherein the relationship between the angular distance between OPEN and CLOSE positions of said operating shaft and the number of said teeth is such as to prevent engagement of said locking coupling and said reversing switch levers when said levers are in the CLOSE position whereby locking of said switches in the CLOSE position by inadvertent operation of said shift actuator is prevented.

11. Apparatus as recited in claim 1 wherein:

said operating shaft is movable in response to operation of said shift actuator means between NORMAL and REVERSE positions in an axial direction with respect to said first and second reversing switch lever means, said non-reversing switch lever means, and said drive lever means;

said locking means comprises a pair of locking couplings surrounding said operating shaft and permitting rotation thereof;

said drive lever means, said non-reversing switch lever means, and said first and second reversing switch lever means each surround said operating shaft and comprise a keyway;

said drive means comprises a drive spline formed in said operating shaft and cooperating with said keyways such that said drive spline engages said first reversing switch lever means keyway when said operating shaft is in the NORMAL position, said drive spline engages said second reversing switch lever means keyway when said operating shaft is in the REVERSE position and said drive spline engages said drive means keyway and said non-reversing switch lever means keyway when said operating shaft is in either position; and said apparatus comprises a stationary support shaft parallel to said operating shaft, said support shaft supporting said drive lever means, said first and second reversing switch lever means, and said non-reversing switch lever means to permit rotation thereof but to prevent axial movement thereof relative to said support shaft; said support shaft slidingly supporting said locking means to prevent rotation thereof but to permit axial movement thereof with respect to said support shaft.

12. Apparatus as recited in claim 11, wherein said drive lever means and said non-reversing switch lever means comprise a single combination lever rigidly connected to said operating shaft and rotatable as a unit therewith.

13. Apparatus as recited in claim 12 wherein:

said drive means comprises a plurality of teeth formed in said combination lever and a plurality of cooperating recesses formed in said first and second reversing switch levers, said recesses engaging said teeth to allow torque to be transmitted from said combination lever to one of said reversing switch levers upon operation of said shift actuator, and said locking couplings comprise a plurality of teeth formed therein and a plurality of cooperating recesses formed in said first and second reversing switch levers, said recesses engaging said teeth to lock one of said reversing switch levers in the open position upon operation of said shift actuator.

14. Apparatus as recited in claim 13 wherein the relationship between the angular distance between OPEN and CLOSE positions of said operating shaft and the number of said teeth is such as to prevent engagement of said locking coupling and said reversing switch levers when said levers are in the CLOSE position whereby locking of said switches in the CLOSE positions by inadvertent operation of said shift actuator is prevented.

* * * * *